US005121765A

United States Patent [19]

MacMorris, Jr.

[11] Patent Number: 5,121,765

[45] Date of Patent: Jun. 16, 1992

[54] PORTABLE COLLAPSIBLE ENCLOSURE

[76] Inventor: Clifford MacMorris, Jr., 1085 Bald Eagle Dr., Marco Island, Fla. 33967

[21] Appl. No.: 549,118

[22] Filed: Jul. 6, 1990

[51] Int. Cl.[5] ..... E04H 15/38

[52] U.S. Cl. ..... 135/103; 135/110; 52/109

[58] Field of Search ..... 135/110, 113, 111, 102; 52/109

[56] References Cited

U.S. PATENT DOCUMENTS

| | | | |
|---|---|---|---|
| 1,712,836 | 5/1929 | Mills . | |
| 1,912,425 | 6/1933 | Baumer . | |
| 2,054,673 | 9/1936 | Hastings | 135/4 |
| 2,486,170 | 10/1949 | Kavanaugh | 135/110 X |
| 2,513,479 | 7/1950 | Harbaugh | 135/110 |
| 2,781,766 | 2/1957 | Krieger | 135/4 |
| 2,864,390 | 12/1958 | Oliver et al. | 135/4 |
| 3,405,721 | 10/1968 | Crosier et al. | 135/7.1 |
| 3,563,257 | 2/1971 | Cummins | 135/4 |
| 3,868,961 | 3/1975 | Sternis | 135/4 R |
| 3,877,544 | 4/1975 | McCollum | 52/109 X |
| 4,013,114 | 3/1977 | Goebel | 52/109 X |
| 4,088,203 | 5/1978 | Smith, Jr. | 52/109 X |
| 4,638,610 | 1/1987 | Heikkinen | 52/109 |
| 4,748,995 | 6/1988 | Viglione | 135/109 |
| 4,835,918 | 6/1989 | Dippel | 52/109 X |
| 4,844,109 | 7/1989 | Navarro | 1315/110 X |

FOREIGN PATENT DOCUMENTS

| | | | |
|---|---|---|---|
| 672815 | 5/1952 | United Kingdom | 135/110 |

*Primary Examiner*—David A. Scherbel
*Assistant Examiner*—Lan Mai
*Attorney, Agent, or Firm*—Merrill N. Johnson

[57] ABSTRACT

A portable collapsible enclosure that can be erected for use or collapsed for transport or storage quickly and easily by a single person exercising minimal effort and possessing minimal skill. The enclosure comprises a plurality of frame members for defining the shape of the enclosure and for supporting a covering for the enclosure, expandable and foldable linking members interconnecting the plurality of frame members and being expandable to position the plurality of frame members and the enclosure defined thereby in an erected state, and foldable to position the plurality of frame members and the enclosure defined thereby in a collapsed state; and actuator members connected to the linkage members for expanding and folding the linkage members to erect and collapse the enclosure. The actuator members preferably comprise fluid-driven linear actuators that once actuated, operate automatically to erect and collapse the enclosure.

13 Claims, 4 Drawing Sheets

PORTABLE COLLAPSIBLE ENCLOSURE

BACKGROUND OF THE INVENTION

The present invention relates generally to a portable enclosure, and, more particularly, to a portable collapsible enclosure that can be erected for use or collapsed for transport or storage quickly and easily by a single person exercising very little effort and possessing minimal skill.

Portable enclosures are used to provide temporary shelter or privacy at camp sites, beaches and other locations. Frequently, such enclosures comprise collapsible structures which can be expanded to an open or erected state for use and collapsed into a compact state for transport or storage. Examples of such collapsible structures are disclosed in U.S. Pat. Nos. 1,912,524 and 2,781,766.

Known portable collapsible enclosures are typically unwieldy and require substantial strength and skill both to erect and collapse the structure. Frequently, the cooperation of more than one person is needed to properly operate the structure, and many prior enclosures have loose parts which can be easily lost or misplaced.

SUMMARY OF THE INVENTION

The present invention provides a portable collapsible enclosure which can be quickly and easily erected for use or collapsed for transport or storage in a matter of seconds by a single individual.

A collapsible enclosure according to the present invention comprises a plurality of frame members for defining the shape of the enclosure and for supporting a covering for the enclosure; expandable and foldable linkage means interconnecting the plurality of frame members, the linkage means being expandable to position the plurality of frame members and the enclosure defined thereby in an erected state, and foldable to position the plurality of frame members and the enclosure defined thereby in a collapsed state; and actuator means connected to the linkage means for expanding and folding the linkage means to erect and collapse the enclosure.

With the present invention, the actuator means performs at least most of the work required to erect or collapse the enclosure, and very little effort and skill is required of the individual operating the structure. In addition, the actuator means substantially automatically locks the enclosure in its fully erected state for use, or in its collapsed state for transport or storage, and locking pins or other loose parts which can be lost or misplaced are generally not required.

In accordance with a presently preferred embodiment of the invention, the actuator means comprises linear actuator means connected to the linkage means in such a manner that linear movement of the actuator means causes the linkage means to expand or fold to, in turn, erect or collapse the enclosure.

Most preferably, the linear actuator means comprises fluid-driven linear actuator means having a small size and a high degree of portability; and may comprise self-operating fluid-driven linear actuator means of the type that once actuated to move in a particular direction, will automatically complete its movement in that direction unassisted, and, thereafter, will become substantially locked in position.

The portable collapsible enclosure of the present invention preferably comprises a base frame member, a top frame member and a plurality of intermediate frame members of generally U-shaped construction. The linkage means preferably comprises a pair of linkage members connected to opposite sides of the frame members, and a separate linear actuator mounted within the base frame member is connected to each linkage member. In its erected state, the enclosure of the present invention provides a sturdy structure which can be conveniently used by one or more persons for privacy or shelter. In its collapsed state, the enclosure provides a lightweight, highly compact structure which can be easily carried or stored.

The portable collapsible enclosure of the present invention can be used in an upright position as a portable toilet, a dressing room, a blind for hunters or for many other purposes. The enclosure may also be tipped over onto its side for use as a tent or as an enclosure for a sleeping bag or the like.

The portable enclosure of the present invention can also be used on the deck of a boat. In this application, the enclosure can be maintained in a box-like structure to retain the enclosure in position on the deck during use and to store the enclosure when not in use.

Yet further important advantages and specific details of the invention will be set forth hereinafter in conjunction with the following detailed description of a presently preferred embodiment thereof.

DETAILED DESCRIPTION OF THE PREFERRED EMBODIMENT

Figure 1:
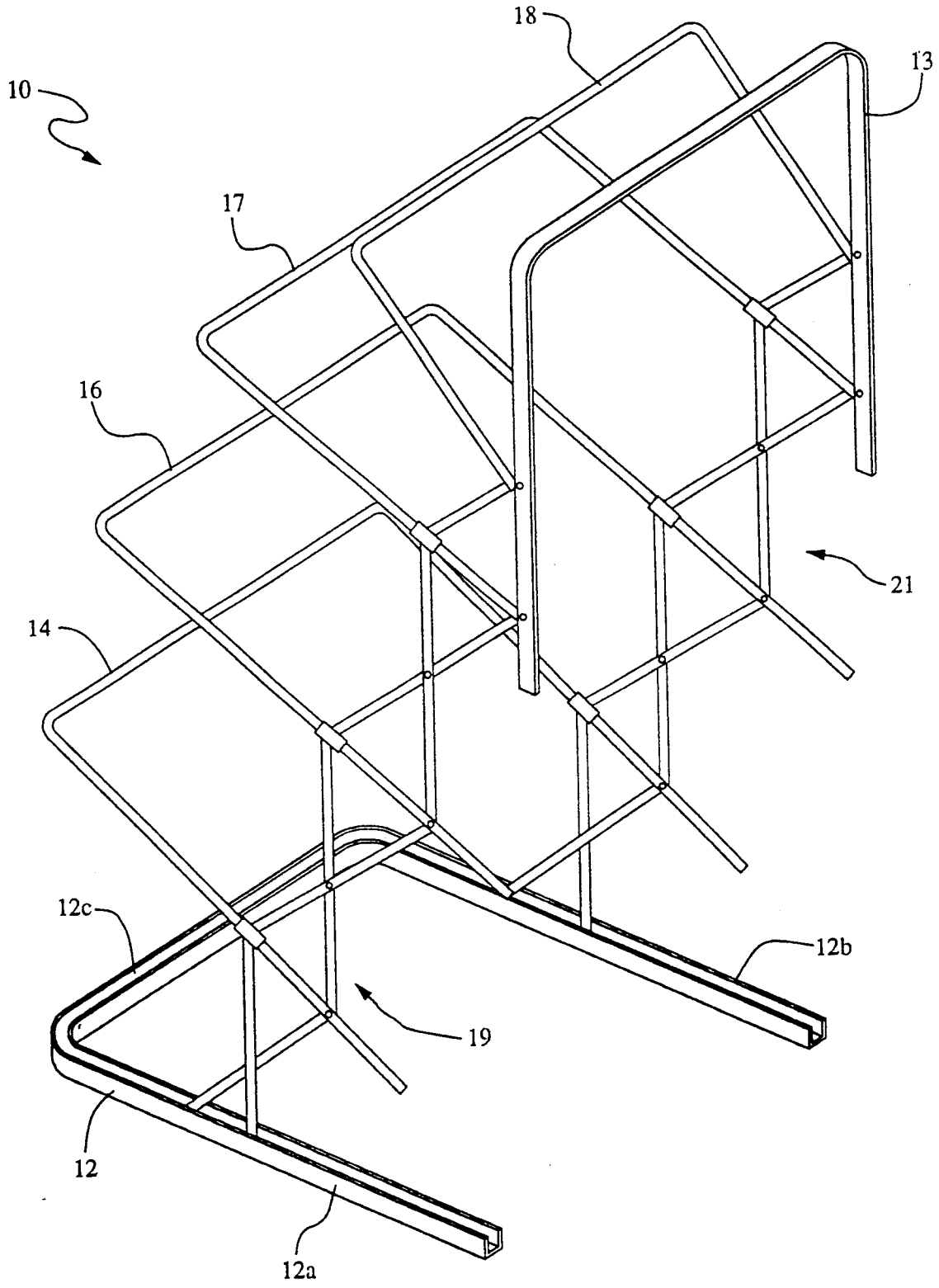
FIG. 1 is a schematic, perspective view of the frame of a portable collapsible enclosure according to a presently preferred embodiment of the invention in an erected state.
Figure 2:
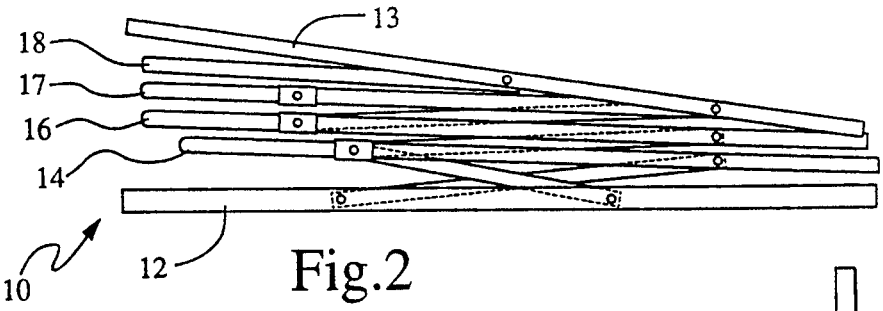
FIG. 2 is side view of the frame of FIG. 1 in a collapsed state.
Figure 3:
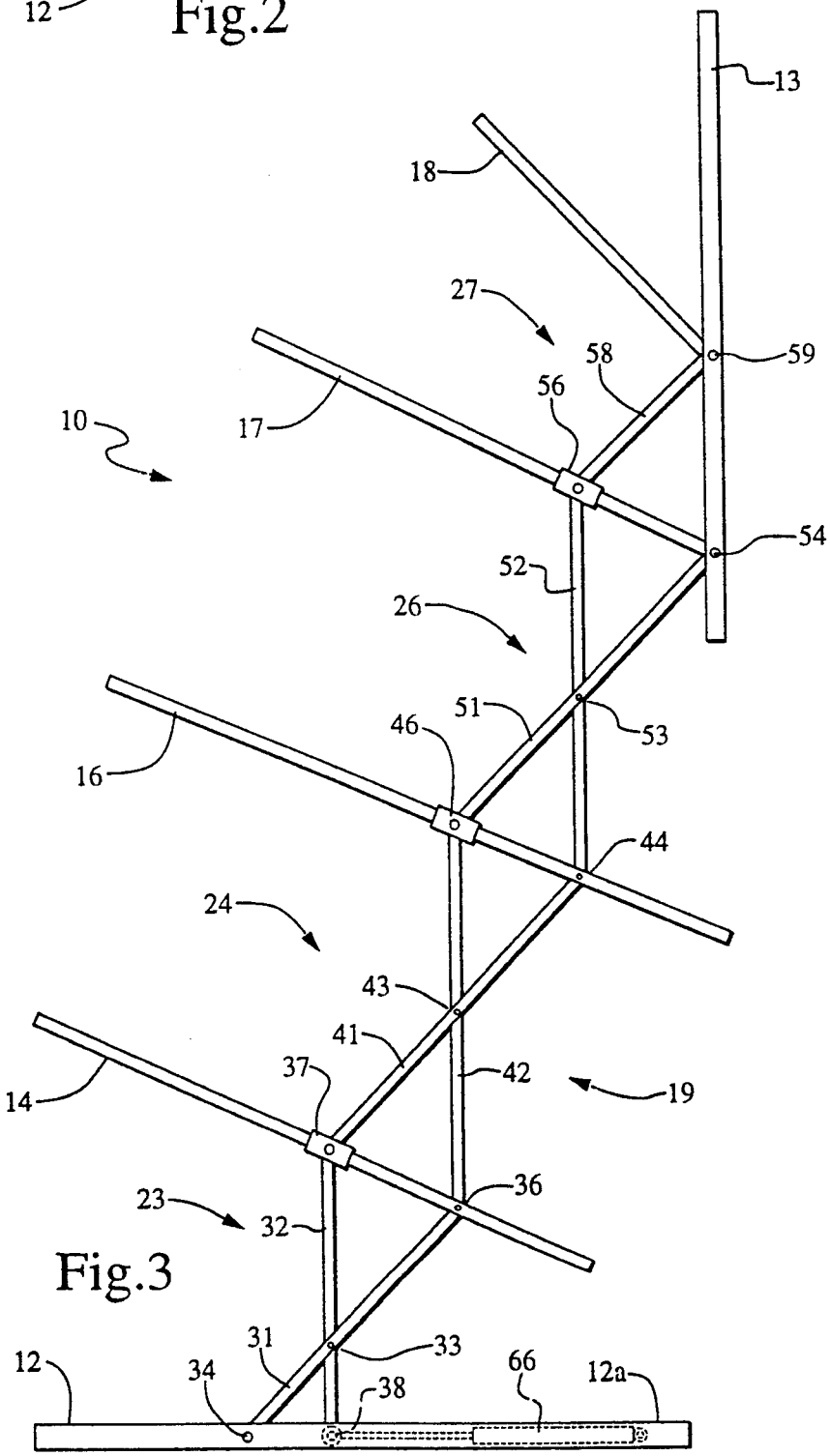
FIG. 3 is a side view of the erected frame of FIG. 1.

FIGS. 1–3 schematically illustrate the frame of a portable collapsible enclosure according to a presently preferred embodiment of the invention. FIG. 1 is a perspective view of the frame in an erected state, FIG. 2 is a side view of the frame in a collapsed state, and FIG. 3 is a side view of the erected frame.

The frame is generally designated by reference number 10 and is adapted to support a covering (shown in FIGS. 5 and 6) for defining an enclosed space to provide privacy or shelter for a user when the enclosure is in its erected state.

Frame 10 generally includes a base frame member 12, a top frame member 13, a plurality of intermediate frame members 14, 16, 17 and 18, and a pair of expandable and foldable linkage members 19 and 21 which interconnect the frame members to one another and which support the top and intermediate frame members relative to the base frame member. The components of the frame are preferably formed of a lightweight aluminum alloy or other suitable material.

Each frame member 12, 13, 14, 16, 17, and 18 comprises a generally U-shaped member having parallel leg sections, e.g., leg sections 12*a* and 12*b* of bottom frame member 12, for defining the side walls of the enclosure, and a back section, e.g., section 12*c* of bottom frame member 12, for defining the back wall of the enclosure. Base frame member 12 is also of U-shaped cross-section to define an upwardly facing channel 22 therein (see FIG. 4A), while top frame member 14 is preferably of L-shaped cross-section. The intermediate frame members are preferably of tubular shape.

Linkage members 19 and 21 are each composed of a plurality of flat bars or links which are pivotally connected to one another to define an accordion-like structure capable of being adjusted between an expanded state illustrated in FIGS. 1 and 3 and a folded state illustrated in FIG. 2. The linkage members are also pivotally connected to the leg sections of the frame members to move the frame members to erect or collapse the enclosure when the linkage members are expanded or folded. The linkage members are identical so only linkage member 19 will be described herein.

With reference to FIG. 3, linkage member 19 comprises first linkage section 23 interconnecting the base frame member 12 and first intermediate frame member 14, second linkage section 24 interconnecting intermediate frame members 14 and 16, third linkage section 26 interconnecting intermediate frame members 16 and 17 and top frame member 13 and fourth linkage section 27 interconnecting intermediate frame members 17 and 18 and top frame member 13. First linkage section 23 comprises a pair of crossed links 31 and 32 (although not shown in the Figures, links 31 and 32 preferably each comprise a pair of spaced bars). Links 31 and 32 are pivotally connected to one another at pivot point 33. In addition, link 31 is connected to base frame member 12 at fixed pivot point 34 and to first intermediate frame member 14 at fixed pivot point 36. Link 32 is pivotally connected to a cylindrical slide 37 slidably mounted on first intermediate frame member 14, and to a roller 38 which is adapted to roll back and forth within the channel 22 of base frame member 12 when the frame is expanded or folded as will be explained hereinafter.

Second linkage section 24 comprises crossed links 41 and 42 centrally connected to one another at pivot point 43. Link 41 is also pivotally connected to slide 37 on first intermediate frame member 14 and is connected to second intermediate frame member 16 at fixed pivot point 44. Link 42 is connected to first intermediate frame member 14 at fixed pivot point 36 and to a slide 46 on second intermediate frame member 16.

Third linkage section 26 comprises crossed links 51 and 52 centrally connected to one another at pivot point 53. Link 51 is also pivotally connected to slide 46 and to third intermediate frame member 17 and top frame member 13 at fixed pivot point 54. Link 52 is connected to second intermediate frame member 16 at fixed pivot point 44 and to a slide 56 on third intermediate frame member 17.

Fourth linkage section 27 comprises a single link 58 having one end pivotally connected to slide 56 and the other end connected to fourth intermediate frame member 18 and to top frame member 13 at fixed pivot point 59.

Figure 4A:
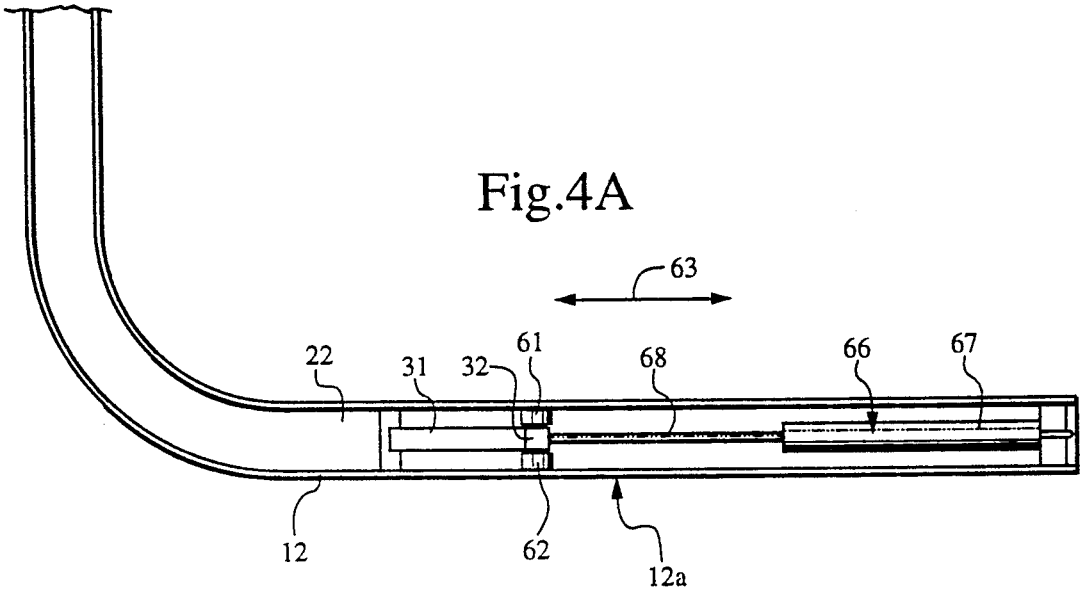
FIGS. 4A and 4B are partial top and side views, respectively, of the base frame member and the first linkage section of the frame of FIGS. 1–3.
Figure 4B:
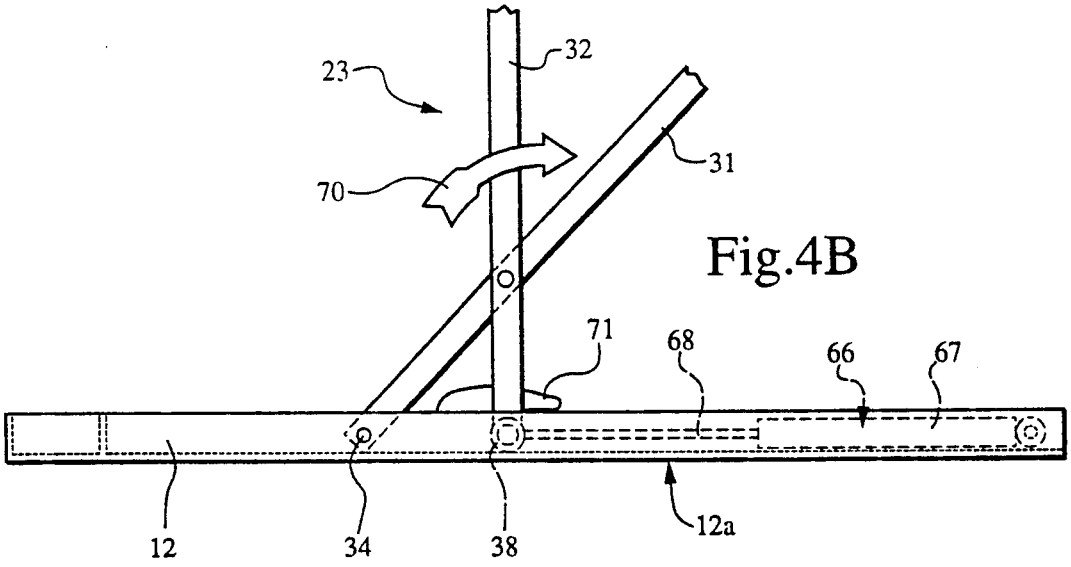

FIGS. 4A and 4B are partial top and side views, respectively, of leg section 12*a* of base frame member 12 and first linkage section 23. As indicated previously, the bottom end of link 32 is attached to a roller 38. As shown in FIG. 4A, roller 38 comprises a structure supporting a pair of wheels 61 and 62 which are adapted to roll back and forth within channel 22 of the base frame member 12 as indicated by arrows 63. The roller structure is connected to a linear actuator 66 mounted within channel 22 toward the front end of the leg section 12*a*. The linear actuator preferably comprises a fluid-driven linear actuator and includes a cylinder 67 having a piston therein (not shown), and a rod 68 connected to the piston and extending outwardly from the end of the cylinder and connected to roller 38. The piston is adapted to be moved back and forth within the cylinder by the force of the fluid in the cylinder, and, in turn, to move the rod 68 linearly between an extended position shown in FIGS. 4A and 4B and a retracted position substantially within the cylinder.

When rod 68 is moved linearly from its retracted position to its extended position, it pushes roller 38 connected thereto and the bottom end of link 32 to the left in FIGS. 4A and 4B, causing link 32 to rotate upwardly in a clockwise direction as indicated by arrow 70 in FIG. 4B from a substantially horizontal orientation to the substantially vertical orientation shown in FIG. 4B. Movement of link 32, in this manner, in turn, causes the entire linkage member 19 to expand upwardly from the base member and to move frame 10 from its compressed state to its erected state. Conversely, when rod 68 is moved linearly from its extended position to its retracted position, it pulls roller 38 and the bottom end of link 32 to the right in FIGS. 4A and 4B causing link 32 to rotate downwardly in the counter-clockwise direction to a substantially horizontal orientation and, in turn, causing the entire linkage member 19 to fold and to collapse the frame 10 attached thereto into the collapsed state shown in FIG. 2.

In the embodiment illustrated, the linkage members 19 and 21 are designed so that the ratio of the length of linear movement of rod 68 to the length of expansion or folding of linkage members 19 and 21 is about one to twelve such that linear movement of rod 68 by about six inches to the left in FIGS. 4A and 4B will result in the linkage members being fully expanded from their folded state to a length of about six feet.

Fluid-driven linear actuator 66 preferably comprises a self-operating linear actuator of the type that once actuated to move in a particular direction, will automatically continue to move in that direction until it reaches the end of its stroke and then will become substantially locked in position. Such actuators are well-known and a suitable actuator is available from the Gas Spring Co., 92 County Line Road, Colman, Pa.; their Model No. 1001.

A latching member 71 may also be provided in the channel 22 to receive and latch roller 38 when the frame is in its erected state.

It should be understood that a linear actuator is mounted within each leg section 12*a* and 12*b* of base frame member 12 to simultaneously drive the two linkage members 19 and 21 of the frame.

To erect the portable enclosure of the present invention, it is essentially only necessary for an individual to position the collapsed enclosure at a desired location, grasp the top frame member 13, and pull upwardly with a relatively slight amount of force. As the top frame member is pulled upwardly, the linkage members 19 and 21 begin to expand and the rollers 38 connected to the bottom end of links 32 begin to move to the left in FIGS. 4A and 4B extending the rods 68 out of their respective cylinders 67. As the pistons in the cylinders start to move to the left in FIGS. 4A and 4B, the actuators become self-operating and the pistons continue to move to the left and the rods 68 continue to move to their extended positions without it being necessary for the individual to continue pulling up on the frame. The actuators continue to operate until their rods 68 are fully extended, the linkage members 19 and 21 to which they are connected are fully expanded and the enclosure is in its fully erected state. At that time, the actuators automatically become locked in position to reliably retain the enclosure in its erected state for use.

To collapse the erected enclosure, it is only necessary to push the top frame member 13 rearwardly and downwardly slightly to initiate retraction operation of the actuators. The actuators will again become self-operating until they are in their fully retracted position, the linkage members have been fully folded, and the enclosure is fully collapsed into its collapsed state of FIG. 2.

The portable collapsible enclosure of the present invention is thus essentially self-erecting and self-collapsing in that it can be erected and collapsed with very little operator involvement or skill being required. With the present invention, the user need only initiate erection or collapsing of the enclosure and the actuators thereafter take over to complete the process in a matter of seconds.

Figure 5:
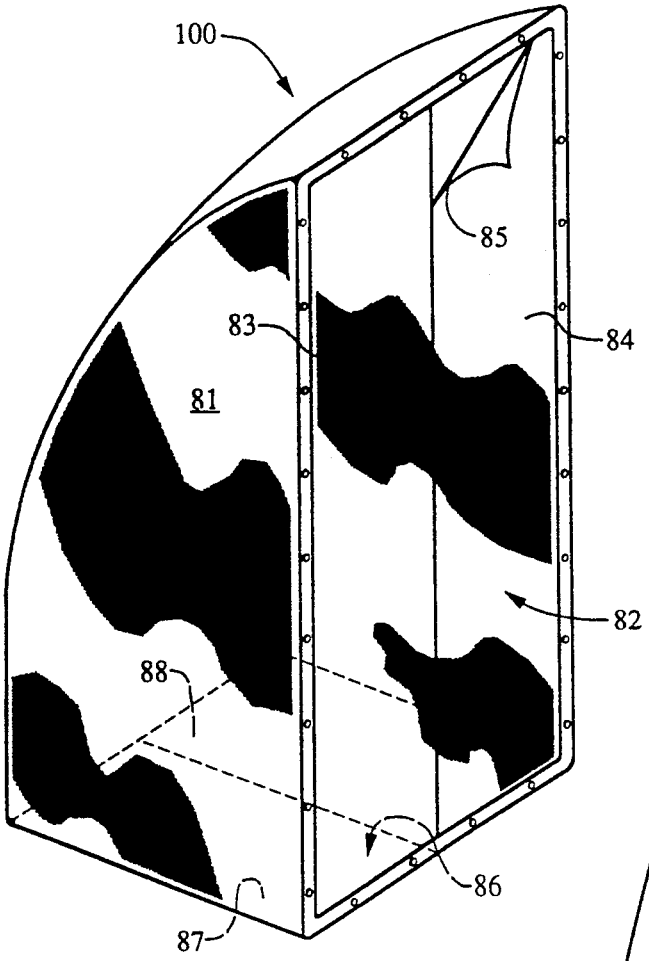
FIG. 5 is a perspective view of the portable collapsible enclosure of the present invention in an erected state.

FIG. 5 illustrates a portable collapsible enclosure 100 according to the present invention. As shown, a covering 81 is affixed to the frame 10 (FIG. 1) to define the enclosure. The covering includes a front wall 82 which can be provided with flaps 83 and 84 to provide access to the interior of the enclosure. A zipper 85 or other suitable closure means can be provided to close the flaps. The covering can be affixed to the frame in any suitable manner and is formed of nylon or other lightweight, flexible material that will readily fold up as the enclosure is collapsed.

In its fully erected state an enclosure according to the present invention may be about six and one-half feet high and cover about a square yard of ground space. In its collapsed state, the structure stands only about nine inches off the ground and is highly compact, such that it may be easily placed into a suitable carrying case for transport or storage. The total weight of the apparatus is only about 18½ pounds, making it highly portable.

With reference to FIGS. 1 and 5, it should also be noted that when the enclosure is in its erected state, the top frame member 13 is substantially perpendicular to the base frame member 12 and is aligned with the front edge of the base frame member. The enclosure thus has substantially flat front and side walls, and a curved back wall. This permits the enclosure to be tilted 90 degrees onto its front side to define a generally horizontal enclosure that can be used as a tent or as an enclosure for a sleeping bag or the like. The bottom wall 86 of the enclosure (shown in dotted line in FIG. 5) is preferably also provided with closable flaps 87 and 88 to provide access to the enclosure when it is in a horizontal orientation.

Figure 6:
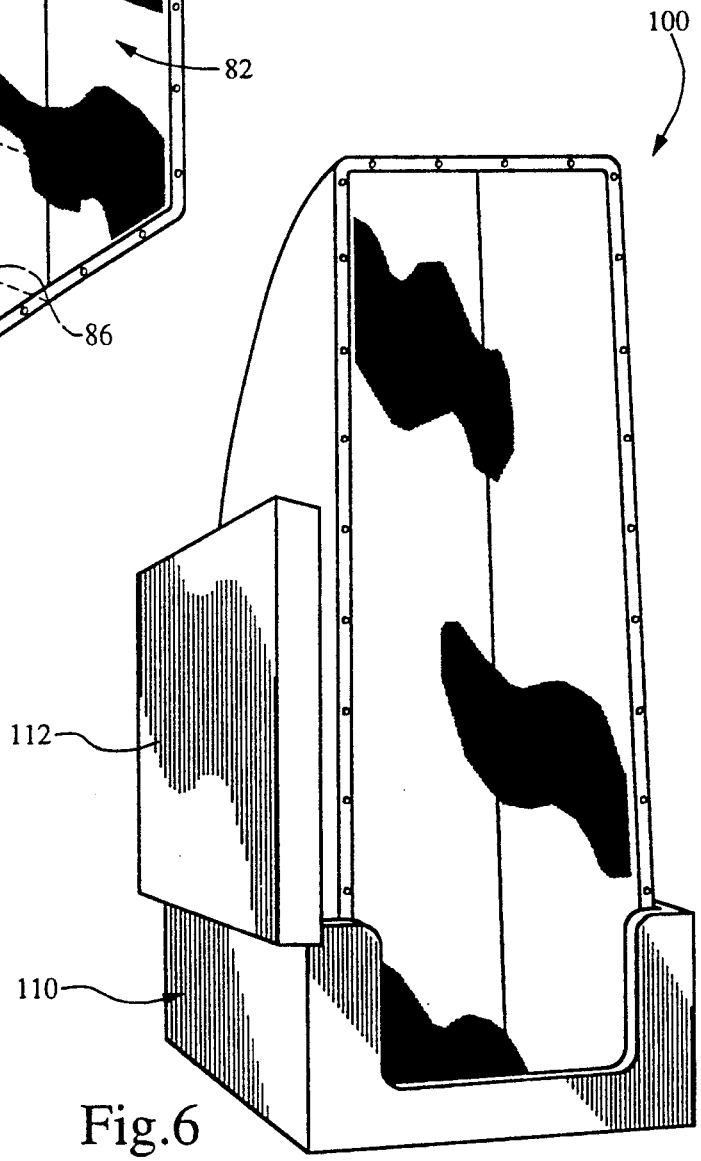
FIG. 6 is a perspective view illustrating an important application for the portable collapsible enclosure of the present invention.

The portable collapsible enclosure of the present invention is particularly suitable for use on the deck of a boat. When used in such an application, the enclosure 100 is preferably retained within a box-like structure 110 as shown in FIG. 6. The box-like structure 110 functions as a support for the enclosure to prevent it from sliding around the deck or being tipped over by the motion of the boat. When the enclosure is in its collapsed state, it fits neatly within the box and a pivoted cover 112 attached to the box can then be lowered to close the box.

While what has been described constitutes a presently preferred embodiment of the invention, it should be recognized that the invention may take numerous other forms. For example, the enclosure could be varied substantially in both size and shape from that described herein depending on the particular application in which the enclosure is to be used. For example, other versions of the enclosure can be used as a protective enclosure for an automobile or to cover the bed of a truck. In addition, various other types of actuator means can be used to erect and collapse the enclosure. For example, a more powerful, hydraulic actuator may be used to erect and collapse larger sizes of the enclosure. Because the invention can take numerous forms, it should be understood that the invention is to be limited only insofar as is required by the scope of the following claims.

I claim:

1. A collapsible enclosure comprising:

a plurality of frame members for defining the shape of the enclosure and for supporting a covering for the enclosures;

expandable and foldable linkage means interconnecting the plurality of frame members, the linkage means being expandable to position the plurality of frame members and the enclosure defined thereby in an erected state, and foldable to position the plurality of frame members and the enclosure defined thereby in a collapsed state; and fluid-driven linear actuator means connected to said linkage means for expanding and folding the linkage means to erect and collapse the enclosure by moving said frame members and said enclosure defined thereby along an arcuate path when said enclosure is erected and collapsed, said fluid-driven linear actuator means comprising substantially self-operating fluid-driven linear actuator means which when once actuated for linear movement in a first direction to expand said linkage means or in a second direction to fold said linkage means will automatically complete its movement in the first and second directions to substantially automatically erect and collapse the enclosure, respectively.

2. The collapsible enclosure of claim 1 wherein said linkage means comprises a pair of linking members and wherein said fluid-driven linear actuator means comprises a fluid-driven linear actuator connected to each of said pair of linkage members.

3. The collapsible enclosure of claim 2 wherein said plurality of frame members includes a base frame member generally adapted to rest upon a support surface, a top frame member and at least one intermediate frame member and wherein said fluid-driven linear actuators are mounted to said base frame member.

4. The collapsible enclosure of claim 1 wherein said linkage means comprises a plurality of links pivotally connected to define an accordion-like structure, and wherein said fluid-driven linear actuator means is connected to one of said links.

5. The collapsible enclosure of claim 1 further comprising a box-like structure for receiving the enclosure, said box-like structure supporting said enclosure when said enclosure is in its erected state and providing a means for storing said enclosure when said enclosure is in its collapsed state.

6. The collapsible enclosure of claim 5 wherein said box-like structure includes a pivoted cover for closing said box-like structure when said enclosure is stored therein in its collapsed state.

7. A portable collapsible enclosure comprising:

a base frame member generally adapted to rest upon the ground or another support surface, a top frame member and at least one intermediate frame member for defining the shape of the enclosure and for supporting a covering for the enclosure;

a pair of expandable and foldable linkage members interconnecting the frame members, each linkage member being expandable to position the frame members and the enclosure defined thereby in an erected state, and foldable to position the frame members and the enclosure defined thereby in a collapsed state; and a linear actuator connected to each of said pair of linkage members for expanding and folding its respective linkage members to erect and collapse the enclosure, said linear actuators comprising substantially self-operating fluid-driven linear actuators which when once actuated for linear movement in a first direction to expand said linkage members or in a second direction to fold said linkage members, will automatically complete their movement in the first and second directions to substantially automatically erect and collapse the enclosure by moving said top frame member and at least one intermediate frame member and said enclosure defined thereby along an arcuate path when said enclosure is erected and collapsed, respectively.

8. The portable collapsible enclosure of claim 7 wherein each of said linkage members comprises a plurality of links pivotally connected to define an accordion-like structure and wherein each of said fluid-driven liner actuators is connected to a link of its respective linkage member.

9. The portable collapsible enclosure of claim 8 wherein each of said fluid-driven linear actuators is mounted to said base frame member, and wherein said link is attached to a roller member movable linearly back and forth along said base frame member by its respective fluid-driven linear actuator.

10. The portable collapsible enclosure of claim 9 wherein said linkage members are designed such that the ratio of the length of linear movement of said fluid-driven linear actuators to the length of expansion or folding of said linkage members is approximately one to twelve.

11. The portable collapsible enclosure of claim 7 wherein said frame members are generally U-shaped.

12. The portable collapsible enclosure of claim 7 wherein said enclosure in an erected state comprises a substantially flat front wall covered by a first portion of said covering, and wherein said covering includes first means for providing access to the interior of the enclosure through said first portion.

13. The portable collapsible enclosure of claim 12 wherein said enclosure also includes a bottom wall covered by a second portion of said covering, said covering including second means for providing access to the interior of said enclosure through said second portion when said enclosure is tilted onto its front wall.

* * * * *